US005863356A

United States Patent [19]

Bölling et al.

[11] Patent Number: 5,863,356

[45] Date of Patent: Jan. 26, 1999

[54] METHOD FOR PRODUCING ELECTRIC SHEETS WITH A GLASS COATING

[75] Inventors: Fritz Bölling, Moers; Brigitte Hammer, Voerde; Thomas Dolle, Duisburg; Klaus Gehnen, Gelsenkirchen; Heiner Schrapers, Duisburg, all of Germany

[73] Assignee: EBG Gesellschaft fur Elektromagnetische Werkstoffe mbH, Bochum, Germany

[21] Appl. No.: 704,579

[22] PCT Filed: Mar. 18, 1995

[86] PCT No.: PCT/EP95/01020

§ 371 Date: Oct. 3, 1996

§ 102(e) Date: Oct. 3, 1996

[87] PCT Pub. No.: WO95/25820

PCT Pub. Date: Sep. 28, 1995

[30] Foreign Application Priority Data

Mar. 22, 1994 [DE] Germany ..... 44 09 691.7

[51] Int. Cl.[6] ..... H01F 1/18

[52] U.S. Cl. ..... 148/122; 148/113

[58] Field of Search ..... 148/113, 122

[56] References Cited

U.S. PATENT DOCUMENTS

| | | | |
|---|---|---|---|
| 3,151,000 | 9/1964 | Schmidt et al. | 148/113 |
| 3,151,997 | 10/1964 | Harvey | 148/113 |
| 4,909,864 | 3/1990 | Inokuti et al. | 148/113 |

FOREIGN PATENT DOCUMENTS

| | | | |
|---|---|---|---|
| 0 232 537 A3 | 8/1987 | European Pat. Off. . | |
| 0 416 420 A2 | 9/1989 | European Pat. Off. . | |
| 55-138021 | 10/1980 | Japan . | |
| 2107783 | 4/1990 | Japan . | |
| 5247661 | 9/1993 | Japan . | |
| 569653 | 9/1977 | U.S.S.R. | 148/113 |
| 2 011 481 | 7/1979 | United Kingdom . | |

*Primary Examiner*—John Sheehan

*Attorney, Agent, or Firm*—Meltzer, Lippe, Goldstein, et al.

[57] ABSTRACT

The invention comprises a method for producing electric sheets, in particular grain-oriented electric sheets, with an evenly well-adhering glass film and with improved magnetic properties, in which the hot rolled strip which is produced at first and is optionally annealed is cold-rolled up to an end thickness in one or several steps, thereafter an annealing separator is applied to the strip which is rolled up to the end thickness, and is dried, and therafter the cold strip thus coated is subjected to high-temperature annealing, with an important component of the annealing separator being a hydrous magnesium oxide (MgO) dispersion and the annealing separator being additionally provided with at least one additive. The characterizing feature of the invention is that a finely dispersed water-soluble sodium phosphate compound is used as at least one additive.

9 Claims, 3 Drawing Sheets

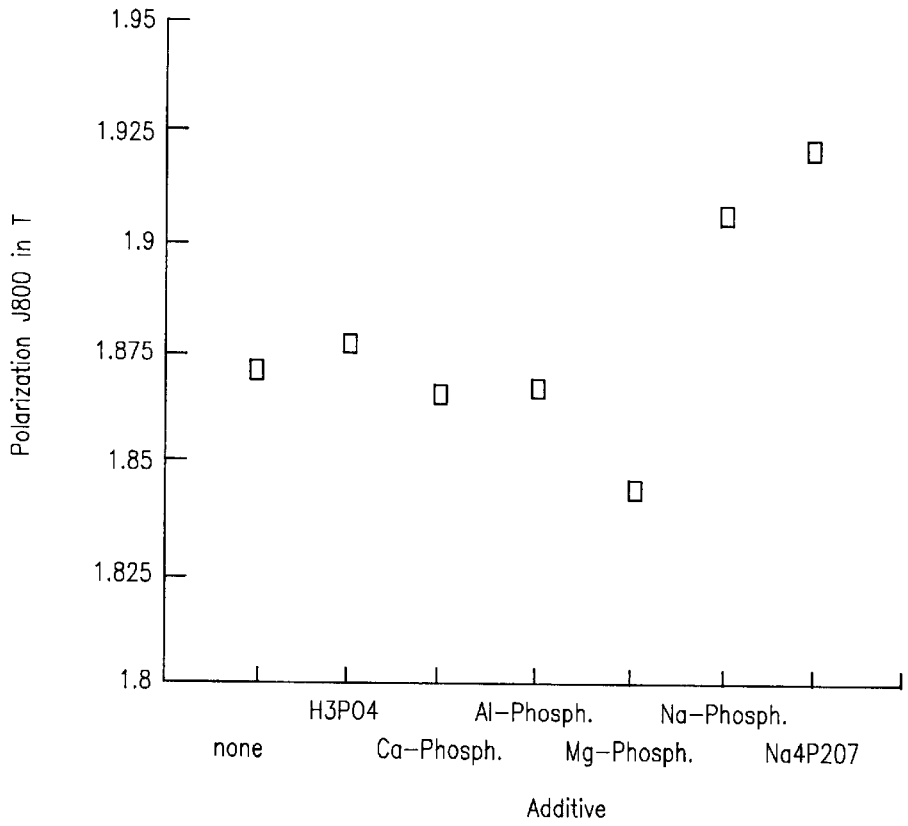
FIG. IA
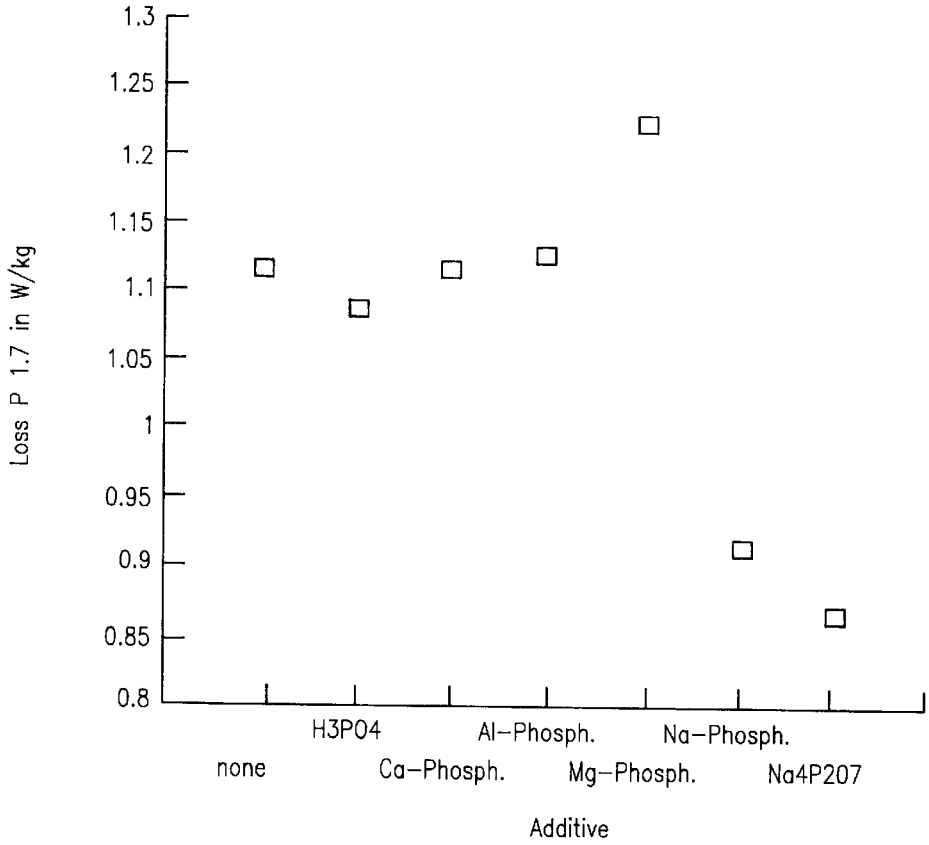
FIG. IB

METHOD FOR PRODUCING ELECTRIC SHEETS WITH A GLASS COATING

FIELD OF THE INVENTION

The invention relates to a method for producing electric sheets, in particular grain-oriented electric sheets, with an evenly well-adhering glass film and with improved magnetic properties, in which the hot rolled strip which is produced at first and is optionally annealed is cold-rolled up to the end thickness of the cold strip with at least one cold rolling stage, thereafter an annealing separator is applied to the strip which is rolled up to the end thickness, and is dried and thereafter the cold strip thus coated is subjected to high-temperature annealing, with an important component of the annealing separator being a hydrous magnesium oxide (MgO) dispersion and the annealing separator being additionally provided with at least one additive.

During the production of grain-oriented electric sheets a decarburization annealing is carried out after the rolling to end thickness. During this process the carbon is extracted from the material. An oxide layer forms on the strip surface as basic layer whose relevant components are silicon dioxide ($SiO_2$) and fayalite ($Fe_2SiO_4$) . Following the decarburization annealing the strip is coated with a antisticking layer and is subjected to long-term annealing in the coil. The antisticking layer is to prevent, on the one hand, the glueing together of the individual coil windings during the long-term annealing and, on the other hand, to form an insulating layer (glass film) with the basic layer on the strip surface. The antisticking layer substantially consists of magnesium oxide (MgO) . The MgO is slurried in form of a powder in water, applied to the strip and dried. During this process a part of the magnesium oxide reacts with the water to form magnesium hydroxide ($Mg(OH)_2$) . The quantity of water bound to the magnesium hydroxide, relating to the overall oxide powder quantity, is known as annealing loss.

The relevant courses and reactions relating to the insulation between strip surface and antisticking layer during the long-term annealing are summarized below in a simplified way:

| | | | | | | | | |
|---|---|---|---|---|---|---|---|---|
| | | | Dehydration of the magnesium hydroxide | | | | | |
| $Mg(OH)_2$ | | | —> | MgO | + | $H_2O$ | | (I) |
| | | | Formation of glass film | | | | | |
| $FeSiO_4$ | + | 2MgO | —> | $Mg_2SiO_4$ | + | 2FeO | | (II) |
| $SiO_2$ | + | 2MgO | —> | $Mg_2SiO_4$ | | | | (III) |

The equation (I) represents the dehydration of the magnesium hydroxide, which starts from approx. 350° C. In this respect it is important for an optimally occurring process, relating both to the insulation as well as to the formation of the magnetic properties, that the quantity of the released water remains within certain limits. The water humidifies the annealing atmosphere which predominantly contains hydrogen and thus establishes a respective oxidation potential. The annealing atmosphere must not be too dry because the glass film would be formed too thinly under such conditions. But it must also not become too humid, because in such a case there would be too much afteroxidization and the glass film would have defective places such as local flaking and unfavourable adherence.

BACKGROUND OF THE INVENTION

In the past a number of additives to the MgO powder were introduced which were to improve the formation of the insulating layer and the magnetic properties of the finished product. These include titanium oxide ($TiO_2$), boron compounds such as boron oxide ($B_2O_3$) or sodium tetraborate ($Na_2B_4O_7$) as well as antimony compounds such as antimony sulphate ($Sb_2(SO_4)_3$) in combination with a chloride, preferably antimony chloride $SbCl_3$. The additives used frequently also showed disadvantages in addition to the positive influences on the respective target values, which reduced the product quality. In summary, the processing of such additives is complicated because they partly have to be dissolved in previously heated water. Particularly in the salts of sodium tetraborate and in particular antimony sulphate, which are difficult to dissolve in water, undissolved coarse particles will lead to inhomogeneities in the antisticking layer and thereafter to local defective places in the glass film. With respect to antimony sulphate it has to be taken into account in addition that the compound is expensive and graded within the category of "low-poisonous" substance. An inhomogenous distribution of titanium oxide in the antisticking layer will lead to defective places in the glass film.

BRIEF DESCRIPTION OF THE DRAWINGS

FIG. 1 shows the influence of different phosphates on magnetic properties.

DETAILED DESCRIPTION OF THE INVENTION

Figure 2A:
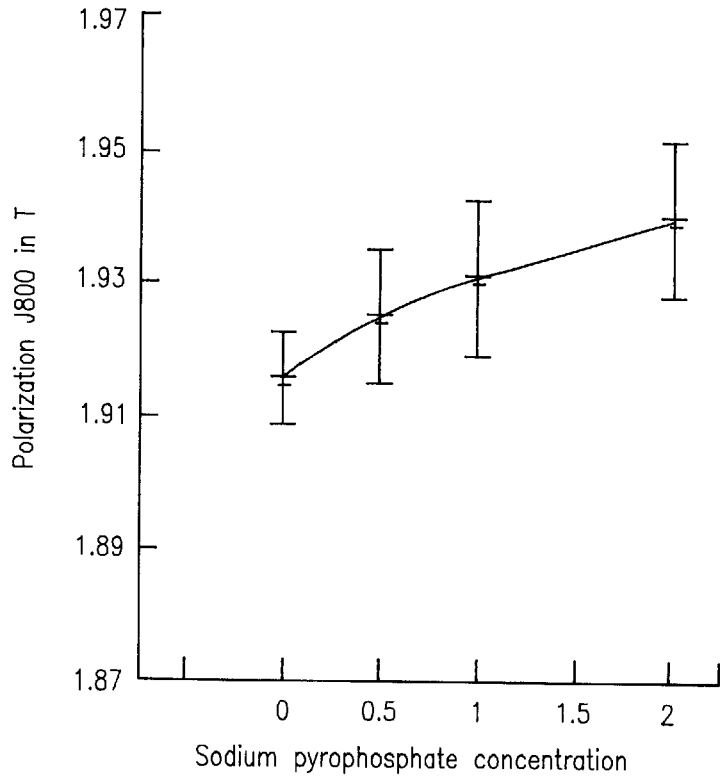
FIG. 2 shows magnetic properties which are dependent on the sodium pyrophosphate concentration.

The invention is based on the object of providing measures, particularly by modifying the annealing separator, in order to further improve the insulating properties and, at the same time, the magnetic properties of the finished product. The antisticking layer is to be applied more homogeneously in order to prevent quality-reducing phenomena such as annealing contours and local defective places. In addition, easy handling is to be ensured and the costs, as compared with the standard, are to be kept low.

To achieve this object it is proposed by the method of this kind in accordance with the invention that a finely dispersed oxidic aluminium compound is used at least as one additive. As an alternative it is proposed in accordance with the invention that a sodium phosphate compound is used at least as one additive which is favourably water soluble. In accordance with a further preferable embodiment of the method in accordance with the invention, a favourably water-soluble sodium phosphate compound and a finely dispersed oxidic aluminium compound can be added in combination to the annealing separator as additives.

The favourable water solubility of the sodium phosphate compound and the finely dispersed distribution of the oxidic aluminium compound in preferable quantities pursuant to the subclaims ensure a homogeneous application of the antisticking layer, prevent coagulations within the hydrous magnesium oxide dispersion and thus ensuing local defective places in the glass film, and promote the chemical reactions occurring in the long-term annealing between the basic layer situated on the strip surface and the antisticking layer to the glass film. As a result of a glass film formation which occurs more strongly as compared with the standard, which has a positive influence on the interaction between the annealing atmosphere and the strips, the magnetic properties of the electric sheets are improved.

A method with the measures of the kind herein is known from EP 2 232 537 B1. In this known method the annealing separator on the basis of MgO is given an additive such as a titanium compound such as $TiO_2$ and/or a borium compound such as $B_2O_3$ and/or a sulphur compound such as SrS with the objective of positively influencing the insulation properties such as adherence and the appearance of the glass film. This is achieved by a hydration of the coating. The magnetic properties were also improved by giving such an additive.

The positive influence on the magnetic properties, on which the invention is based, is characteristic for sodium phosphates.

FIG. 1 shows the superiority of the samples produced in accordance with the invention with an antisticking layer on the basis of MgO doped with sodium phosphate over other phosphate additives. HGO (high permeability grain oriented) strip samples were coated, dried and fully annealed with MgO+6% $TiO_2$+the additives as mentioned above.

The sodium phosphates are favourably water soluble, and thus enable an optimal homogeneous distribution within the antisticking layer. Both the magnetic properties of the polarization and cyclic magnetization loss as well as the insulation formation are improved by using the sodium phosphates, shown in this case in particular by the example of the sodium pyrophosphate decahydrate. In the inhibitor test method it is proved that the sodium pyrophosphate leads to a earlier stronger formation of the glass film. The inhibitor test constitutes a method in which principally high-temperature annealings are interrupted at certain annealing temperatures and the samples are evaluated magnetically. In the present case insulation formations were additionally evaluated.

EXAMPLE 1

Three strip samples from three strips of grain-oriented electric sheets of HGO quality (high permeability grain oriented) and the thickness of 0.23 mm were coated, on the one hand, with a hydrous magnesium oxide dispersion and, on the other hand, with a hydrous magnesium oxide dispersion to which 0.75% sodium pyrophosphate decahydrate relating to 100% magnesium oxide were added. After the strip samples had been fully annealed according to the state of the art, the magnetic characteristics were determined. Table 1 shows the magnetic characteristics for polarization $J_{800}$ and the cyclic magnetization loss $P_{1.7}$ for the comparison of the two coatings.

TABLE 1

Influence on the magnetic properties by sodium pyrophosphate as additive to MgO

| □ | 100% | 99.25% MgO |
|---|---|---|
| Composition of antisticking layer | | 0.75% $Na_4P_2O_7.10H_2O$ |
| $J_{800}$ in T | 1.909 | 1.933 |
| $P_{1.7}$ in W/kg | 1.118 | 0.995 |

EXAMPLE 2

6 strip samples made from grain-oriented electric sheet (HGO) of nominal thickness of 0.23 mm, whose chemical compositions lay randomly within the analytic ranges of

Figure 2B:
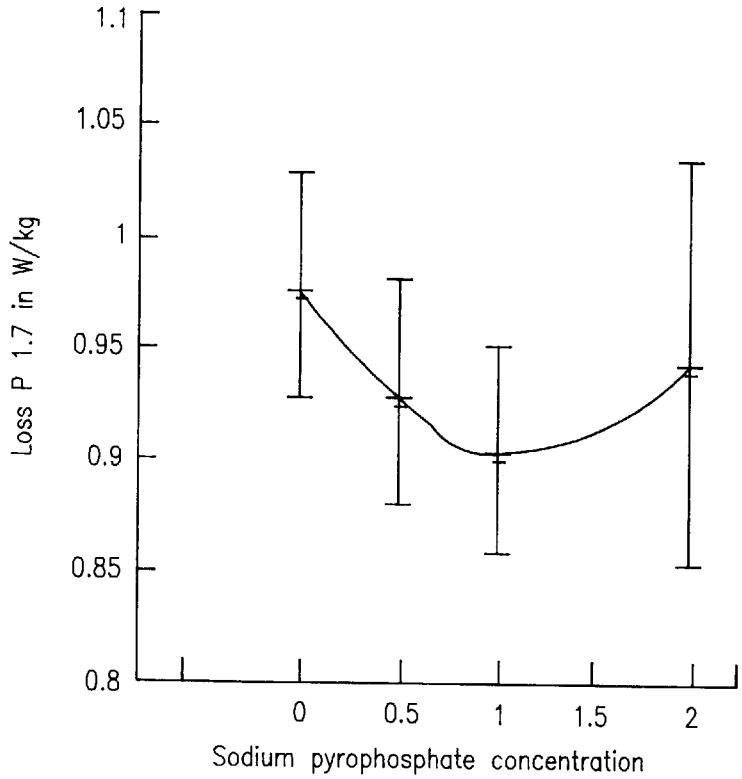

| Si % | C % | Al % | Mn % | Sn % | N % | S % |
|---|---|---|---|---|---|---|
| 3.17–3.29 | 0.065–0.070 | 0.025–0.026 | 0.074–0.080 | 0.118–0.120 | 0.0077–0.0087 | 0.025–0.028 |

were processed according to the state of the art up to and including decarburization, coated with a separating agent on the basis of magnesium oxide and 6 weight parts of titanium dioxide, relating to 100 weight parts MgO, as well as the additives as set out in table 2 and thereafter fully annealed according to the state of the art. The magnetic properties of the cyclic magnetization loss $P_{1.7}$ and polarization $J_{800}$ were determined in the fully annealed strips and the glass film appearance was categorized. Table 2 and FIG. 2 show the results.

TABLE 2

Influence of various sodium pyrophosphate concentrations on the magnetic properties and the glass film appearance

| Additive Evaluation parameter | MgO + 6% $TiO_2$ + additive in weight parts relating to 100 weight parts MgO | | | |
|---|---|---|---|---|
| Sodium pyrophosphate decahydrate $Na_4P_2O_7.10H_2O$ | 0 | 0.5 | 1 | 2 |
| Glass film appearance | Annealing contours | Free from annealing contours | Free from annealing contours | Spotty |
| $P_{1.7}$ in W/kg | 0.979 | 0.930 | 0.904 | 0.943 |
| $J_{800}$ in T | 1.916 | 1.925 | 1.931 | 1.940 |

EXAMPLE 3

29 strip samples from grain-oriented electric sheet (HGO) of nominal thickness of 0.23 mm, whose chemical compositions lay randomly within the analytic ranges of

| Si % | C % | Al % | Mn % | Sn % | N % | S % |
|---|---|---|---|---|---|---|
| 3.13–3.30 | 0.063–0.067 | 0.024–0.028 | 0.072–0.082 | 0.075–0.121 | 0.0077–0.0090 | 0.020–0.027 |

were processed with the method according to the state of the art up to and including decarburization, coated with a separating agent on the basis of magnesium oxide and 6 weight parts of titanium dioxide, relating to 100 weight parts MgO, as well as the additives as set out in table 3 and thereafter fully annealed according to the state of the art. The magnetic properties of the cyclic magnetization loss $P_{1.7}$ and polarization $J_{800}$ were determined in the fully annealed strips and the glass film appearance was categorized.

TABLE 3

Comparison of the standard coatings with an antisticking layer with 1% sodium pyrophosphate

| Additive Evaluation parameter | MgO + 6% $TiO_2$ + additive in weight parts relating to 100 weight parts MgO | | |
|---|---|---|---|
| Sodium tetraborate decahydrate $Na_2B_4O_7*10H_2O$ | 0 | 0.3 | 0 |
| Sodium pyrophosphate decahydrate $Na_4P_2O_7*10H_2O$ | 0 | 0 | 1 |
| Antimony sulphate $Sb_2(SO_4)_3$ | 0 | 0.1 | 0 |
| Glass film appearance | Annealing contours | Annealing contours | Free from annealing contours |
| $P_{17}$ in W/kg | 0.992 | 0.965 | 0.902 |
| $J_{800}$ in T | 1.904 | 1.913 | 1.925 |

Improvement of the process

EXAMPLE 4

Electric sheet samples of a thickness of 0.29 mm and the chemical compositions

| | Si % | C % | Al % | Mn % | Sn % | N % | S % |
|---|---|---|---|---|---|---|---|
| Sample 1 | 3.13 | 0.061 | 0.020 | 0.070 | 0.075 | 0.0078 | 0.024 |
| Sample 2 | 3.08 | 0.061 | 0.020 | 0.080 | 0.026 | 0.0076 | 0.023 |

were provided with a coating consisting of magnesium oxide and 6% $TiO_2$ and with the additives as listed in the following table and then fully annealed. The results are compiled in table 4.

TABLE 4

Comparison of the standard coating with an antisticking layer with 1.5% sodium pyrophosphate

| Additive Evaluation parameter | MgO + 6% $TiO_2$ + additive in weight parts relating to 100 weight parts MgO SAMPLE 1 | | SAMPLE 2 | |
|---|---|---|---|---|
| Sodium tetraborate decahydrate $Na_2B_4O_7*10H_2O$ | 0.3 | 0 | 0.3 | 0 |
| Sodium pyrophosphate decahydrate $Na_4P_2O_7*10H_2O$ | 0 | 1.5 | 0 | 1.5 |
| Antimony sulphate $Sb_2(SO_4)_3$ | 0.1 | 0 | 0.1 | 0 |
| $P_{17}$ in W/kg | 1.216 | 1.099 | 1.190 | 1.054 |
| $J_{800}$ in T | 1.886 | 1.923 | 1.901 | 1.928 |

EXAMPLE 5

Strips made from grain-oriented electric sheets of nominal thickness of 0.23 mm, which were processed with the method in accordance with the state of the art up to and including decarburization, were coated with a separating agent on the basis of magnesium oxide and 6 weight parts of titanium dioxide, relating to 100 weight parts MgO, as well as the additives as set out in table 5 and thereafter fully annealed according to the state of the art. The magnetic properties of the cyclic magnetization loss $P_{1.7}$ and polarization $J_{800}$ were determined in the fully annealed strips.

TABLE 5

Influence of different Na phosphates on the magnetic properties

| Additive Evaluation parameter | MgO + 6% $TiO_2$ + additive in weight parts relating to 100 weight parts MgO | | | | | |
|---|---|---|---|---|---|---|
| Sodium tetraborate decahydrate $Na_2B_4O_7.10H_2O$ | 0 | 0.3 | 0 | 0 | 0 | 0 |
| Sodium pyrophosphate decahydrate $Na_4P_2O_7.10H_2O$ | 0 | 0 | 1.5 | 0 | 0 | 0 |
| Disodium hydrogen phosphate $Na_2HPO_4.2H_2O$ | 0 | 0 | 0 | 1.2 | 0 | 0 |
| Trisodium orthophosphate $Na_3PO_4.12H_2O$ | 0 | 0 | 0 | 0 | 2.55 | 0 |
| Ammonium sodium hydrogen phosphate $NaNH_4HPO_4$ | 0 | 0 | 0 | 0 | 0 | 1.4 |
| Antimony sulphate $Sb_2(SO_4)_3$ | 0 | 0.1 | 0 | 0 | 0 | 0 |
| $P_{1.7}$ in W/kg | 0.983 | 0.942 | 0.937 | 0.956 | 0.992 | 0.949 |
| $J_{800}$ in T | 1.918 | 1.926 | 1.932 | 1.925 | 1.927 | 1.916 |

The aluminium compounds used are aluminium oxides or hydroxides of the form $Al_2O_3$, $Al(OH)_3$ and AlO(OH), whose effect is fully exploited when the respective particle sizes are small. The effect is shown particularly in cases where the compounds are added in form of brine (very fine particle/water mixtures). The particle size should be smaller than 100 nm (=0.1 $\mu$m) on the average with the narrowest possible distribution of particle sizes. The addition of these aluminium compounds leads to a substantial improvement of the loss, as is the case similarly with the addition of titanium oxide. The advantage of aluminium compounds as addition over titanium dioxide is the lower dosage of additions and the more homogeneous distribution of the particles. A further advantage is due to the fact that the added aluminium compounds also have the property of a ceramic binder, i.e. the antisticking layer therefore adheres better to the strip.

EXAMPLE 6

4 strip samples made from grain-oriented electric sheet of nominal thickness of 0.23 mm, whose chemical compositions lay randomly within the analytic ranges of

Figure 3A:
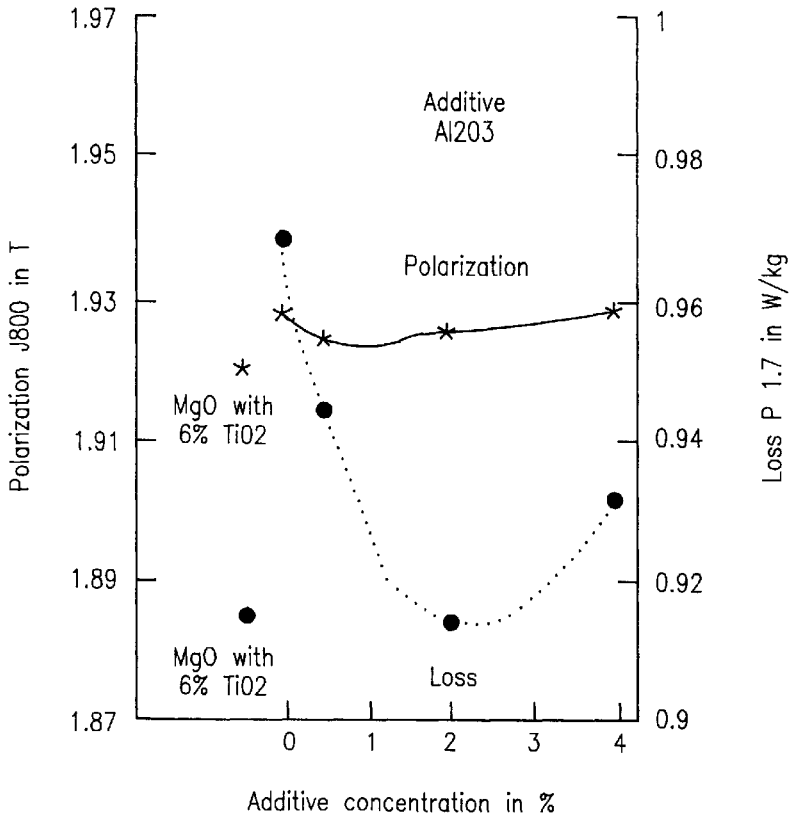
FIG. 3 shows magnetic properties which depend on the concentration of the oxidic aluminum compound.
Figure 3B:
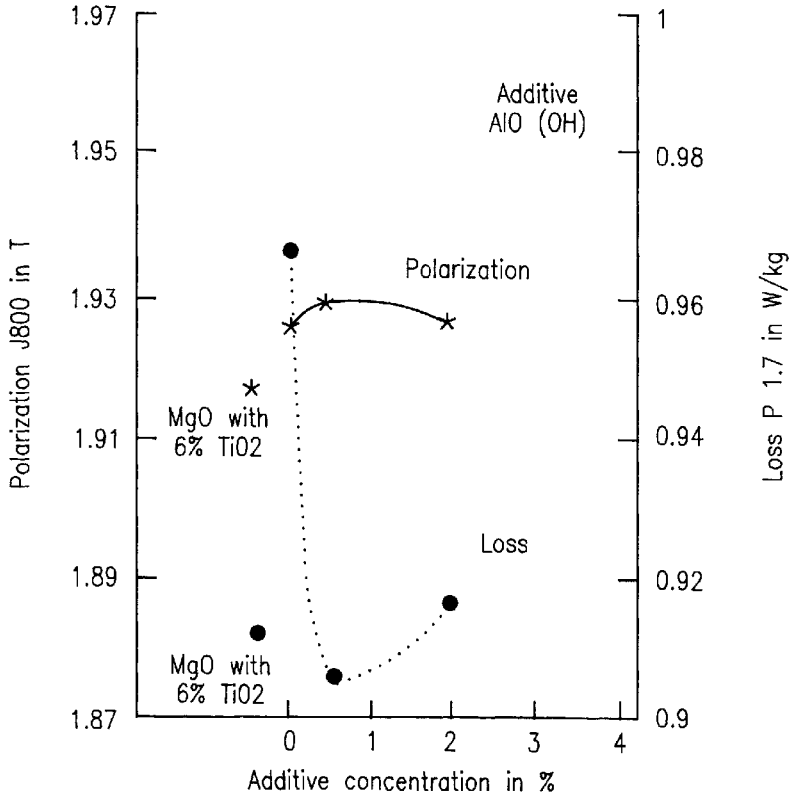

| Si % | C % | Al % | Mn % | Sn % | N % | S % |
|---|---|---|---|---|---|---|
| 3.23–3.29 | 0.065–0.073 | 0.025–0.028 | 0.073–0.077 | 0.117–0.119 | 0.0084–0.0090 | 0.021–0.027 |

were processed with the method in accordance with the state of the art up to and including decarburization, were coated with a separating agent on the basis of magnesium oxide as well as the additives as set out in table 6 and thereafter fully annealed according to the state of the art. The magnetic properties of the cyclic magnetization loss $P_{1.7}$ and polarization $J_{800}$ were determined in the fully annealed strips and the glass film appearance was categorized. Table 6 and FIG. 3 show the substantial influence of the selected aluminium compounds on the cyclic magnetization loss.

TABLE 6

The influence of different oxidic aluminium compounds on the magnetic properties and the glass film appearance

| Additive Evaluation parameter | | | | |
|---|---|---|---|---|
| | MgO + 6% $TiO_2$ + additive in weight parts relating too weight parts MgO | | | |
| Aluminium oxide $Al_2O_3$ | 0 | 0.5 | 2 | 4 |
| Glass film appearance | Annealing contours | Even | Too thin | Too thin |
| $P_{1.7}$ in W/kg | 0.968 | 0.944 | 0.914 | 0.931 |
| $J_{800}$ in T | 1.928 | 1.924 | 1.925 | 1.928 |
| Boehmite AlO(OH) | 0 | 0.5 | 2 | — |
| Glass film appearance | Annealing contours | Even | Too thin | — |
| $P_{1.7}$ in W/kg | 0.968 | 0.906 | 0.917 | — |
| $J_{800}$ in T | 1.928 | 1.931 | 1.928 | — |
| | Comparison MgO + additive of titanium dixoxide in weight parts relating to MgO | | | |
| Titanium dioxide $TiO_2$ | 0 | 6 | | |
| Glass film appearance | Annealing contours | Annealing contours | | |
| $P_{1.7}$ in W/kg | 0.968 | 0.913 | | |
| $J_{800}$ in T | 1.928 | 1.919 | | |

The effect of the aforementioned additives is optimized when suitable combinations of additives are used. Positive effects are also achieved in combination with already used additives such as titanium dioxide, antimony sulphate and sodium tetraborate. A combination of finely dispersed oxidic aluminium compound and a favourably water-soluble sodium phosphate has proved to be optimal with respect to the slurry properties and thus the homogeneity of the MgO layer, because considerably fewer local defective places were observed with these additives.

EXAMPLE 7

Samples from a strip made from grain-oriented electric sheets of nominal thickness of 0.23 mm, which were processed with the method in accordance with the state of the art up to and including decarburization, were coated with a separating agent on the basis of magnesium oxide as well as the additives as set out in table 7 and thereafter fully annealed according to the state of the art. The magnetic properties of the cyclic magnetization loss $P_{1.7}$ and polarization $J_{800}$ were determined in the fully annealed strips.

TABLE 7

Example of a combination of new additives in comparison with the state of the art

| Additive Evaluation parameter | MgO + 6% $TiO_2$ + additive in weight parts relating to 100 weight parts MgO | | | |
|---|---|---|---|---|
| Titanium dioxide $TiO_2$ | 6 | 6 | 6 | 0 |
| Sodium tetraborate decahydrate $Na_2B_4O_7*10H_2O$ | 0 | 0.3 | 0 | 0 |
| Sodium pyrophosphate decahydrate $Na_4P_2O_7*10H_2O$ | 0 | 0 | 0.75 | 0.75 |
| Antimony sulphate $Sb_2(SO_4)_3$ | 0 | 0.1 | 0 | 0 |
| Boehmite AlO(OH) | 0 | 0 | 0 | 0.5 |
| $P_{1.7}$ in W/kg | 0.996 | 0.964 | 0.946 | 0.912 |
| $J_{800}$ in T | 1.911 | 1.914 | 1.924 | 1.932 |

We claim:

1. A method for producing electric sheets with an evenly well-adhering glass film and with improved magnetic properties, in which a hot rolled strip which is produced at first is cold-rolled up to an end thickness of a cold strip with at least one cold rolling stage, thereafter an annealing separator is applied to the cold strip and is dried, and thereafter the cold strip which is thus coated is subjected to a high-temperature annealing, with a hydrous magnesium oxide (MgO) dispersion being a major component of the annealing separator and the annealing separator being provided with at least one additive, wherein the additive is a water-soluble sodium phosphate compound.

2. The method of claim 1, wherein at least two additives are used which comprise the water-soluble sodium phosphate compound and a finely dispersed oxidic aluminum compound.

3. The method of claim 1, wherein 0.05 to 4 wt. % sodium phosphate, relative to MgO, is added to the annealing separator as additive.

4. The method of claim 1, wherein 0.05 to 4.0 wt. % of an oxidic aluminum compound comprising $Al_2O_3$, $Al(OH)_3$ or AlO(OH), relative to MgO, is added to the annealing separator as additive.

5. The method of claim 1, wherein 0.3 to 1.5 wt. % of sodium pyrophosphate decahydrate, relative to MgO, is added to the annealing separator as additive.

6. The method of claim 2, wherein the oxidic aluminum compound is used with a particle size below 100 nm.

7. The method of claim 1, wherein additives comprising titanium dioxide, boron dioxide, sodium tetraborate, antimony sulfate, or metal chlorides are added to the annealing separator.

8. The method of claim 1, wherein the electric sheets are grain-oriented electric sheets.

9. The method of claim 1, wherein the hot rolled strip is annealed.

* * * * *